US006173957B1

(12) United States Patent
James, Sr.

(10) Patent No.: US 6,173,957 B1
(45) Date of Patent: Jan. 16, 2001

(54) TOSSING GAME

(76) Inventor: James G. James, Sr., 41 Hawthorne Ave., Pittsburgh, PA (US) 15205

( * ) Notice: Under 35 U.S.C. 154(b), the term of this patent shall be extended for 0 days.

(21) Appl. No.: 09/269,419

(22) PCT Filed: Sep. 25, 1997

(86) PCT No.: PCT/US97/17210

§ 371 Date: Mar. 26, 1999

§ 102(e) Date: Mar. 26, 1999

(87) PCT Pub. No.: WO98/13110

PCT Pub. Date: Apr. 2, 1998

Related U.S. Application Data

(60) Provisional application No. 60/026,837, filed on Sep. 27, 1996.

(51) Int. Cl.[7] ..... A63B 71/02

(52) U.S. Cl. ..... 273/440; 273/400; 273/350; 473/466

(58) Field of Search ..... 273/398–402, 273/348, 349, 350, 440; 473/466, 478

(56) References Cited

U.S. PATENT DOCUMENTS

| | | |
|---|---|---|
| D. 349,930 | 8/1994 | Killion . |
| 3,350,097 | 10/1967 | Chevrette et al. . |
| 3,403,907 | 10/1968 | Keller . |
| 3,469,844 | 9/1969 | Sindelar . |
| 3,652,090 | 3/1972 | Semmens . |
| 3,895,801 | 7/1975 | Baird . |
| 3,942,798 | 3/1976 | Koski . |
| 4,168,066 | 9/1979 | Sole et al. . |
| 4,204,682 | 5/1980 | Brown . |
| 4,392,653 | 7/1983 | Blume, Sr. . |
| 4,877,256 | 10/1989 | Falloon . |
| 5,316,310 | 5/1994 | Nicholas, Sr. et al. . |
| 5,318,307 | 6/1994 | Bouchard et al. . |
| 5,632,490 | 5/1997 | Brown . |

*Primary Examiner*—Mark S. Graham
(74) *Attorney, Agent, or Firm*—Webb Ziesenheim Logsdon Orkin & Hanson, P.C.

(57) ABSTRACT

A tossing game including a plurality of moveable targets having an upward facing opening and a plurality of projectiles for being tossed for accuracy into the opening. Indicia on the projectiles match respective indicia on the targets. The target may be constructed as a tube or similar shape. The target is inflatable for portability and flotation.

4 Claims, 1 Drawing Sheet

TOSSING GAME

This application claims the benefit of provisional patent application 60/026,837, filed Sep. 27, 1996.

BACKGROUND OF THE INVENTION

1. Field of the Invention

This invention is related to a game and a method for playing a game whereby a projectile is tossed at a target and points are scored depending on the accuracy of the toss.

2. Description of the Prior Art

A number of tossing games have been described:

U.S. Pat. No. 4,168,066 to Sole et al., granted Sep. 18, 1979, describes a game wherein gliding discs are tossed through target rings for varying point totals depending upon which ring the disc is tossed through.

U.S. Pat. No. 4,204,682 to Brown, granted May 27, 1980, discloses a recessed horizontal target, much like an enlarged version of cups used as targets in golf courses, toward which a "marker" is tossed. Points are scored for tossing the "marker" in varying proximity to the target. U.S. Pat. No. 4,877,256 to Falloon granted Oct. 31, 1989 teaches a tossing game comprising a plurality of cups into which a projectile is tossed.

U.S. Pat. No. 5,316,310 to Nicholas, Sr. et al., granted May 31, 1994, discloses a textured mat with target markers upon which a disc is tossed for varying numbers of points depending on where the disc is tossed in relationship to the mat.

The prior art discloses games wherein a projectile is tossed at a target and points are scored for accuracy. The prior art, however, does not disclose a game whereby a projectile is tossed into a tube, wherein the tube is oriented in a substantially horizontal position.

It is therefore an object of the present invention to provide a tossing game having certain advantages over prior art tossing games. Use of a substantially toroidal tube or similar shapes as a target has certain substantial advantages over the prior art providing for three- or four-tier scoring derived from the unique shape of the target, depending on where the projectile lands in relation to the target. It is also an object of the present invention to provide a target that is easily moveable, where there are no holes to dig and where the target may be used in water. It is a further object of the present invention to provide projectiles and targets which may be large or small, depending upon whether adults or children play, where the game is to be played and the skill level of the players. Lastly, it is an object of the present invention to provide targets and projectiles that are safe for users of all ages.

SUMMARY OF THE INVENTION

The present invention is directed to a tossing game including a moveable target having an upward-facing opening and a projectile, the projectile being tossed for accuracy into the opening. Points are variably scored for accuracy in tossing the projectile towards the opening. Use of a tube or similar shapes as a target provides three- or four-tier scoring derived from the unique shape of the target, depending on where the projectile lands in relation to the target. The projectiles and targets may be large or small depending on whether adults or children play, where the game is to be played and the skill level of the players. The game can be played by setting the targets afloat in water.

Construction of the targets and projectiles can be of a variety of materials. The tubes and projectiles can be of a soft foam for indoor use and safety purposes. The targets can be inflatable, for portability. The targets can have a softer outer wall for safety reasons. The targets, having a large surface area, can have indicia imprinted upon or attached to an outward facing surface, allowing for display of advertisements, playing instructions, warnings and the like. The targets can have hooks for anchoring the targets against unintended movement.

DETAILED DESCRIPTION OF THE PREFERRED EMBODIMENTS

Figure 1:
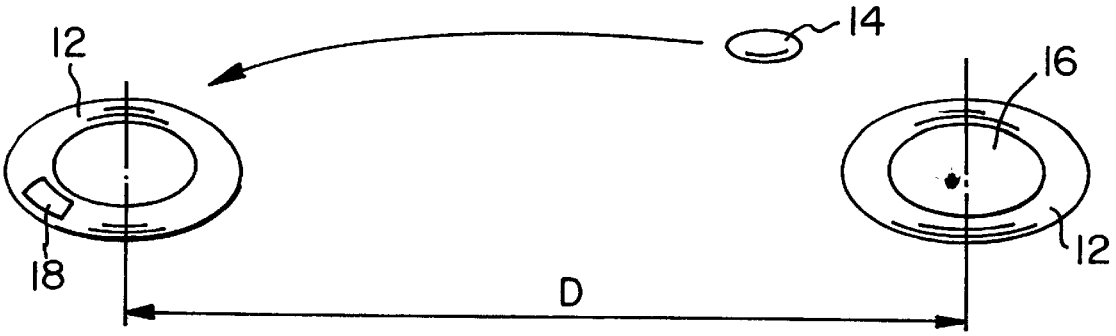
FIG. 1 is an elevation view of one embodiment of a tossing game.

A tossing game according to the present invention is shown in FIG. 1. FIG. 1 shows one embodiment of the game wherein two targets 12 are used. The tossing game includes one or more targets 12. Preferably, targets 12 are placed on a horizontal surface, such as on ground, or in water. If two targets 12 are to be used, they may be spaced at a predetermined distance D from each other. Projectile 14 is tossed from a distance, preferably distance D, or another desired distance, toward target 12 for accuracy and to score points if scoring is desired.

Figure 2:
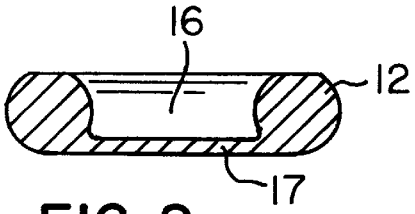
FIG. 2 is a side sectional view of a target having an opening which does not pass completely through the target.
Figure 3:
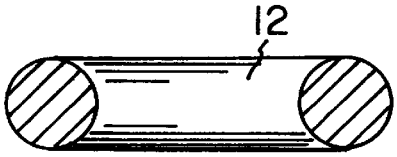
FIG. 3 is a side sectional view of a target having a solid cross-section of a single material.

As shown in FIG. 1, the target 12 can have a toroidal shape with an opening 16. The projectile 14 is tossed toward and preferably into the opening 16 to score points. Opening 16 may not pass completely through target 12 as shown in FIG. 2 or it may pass completely through the target 12 as shown in FIG. 3. Target 12 may have indicia 18 or an indicia assembly, such as a pocket or a hook-and-loop fastener, for placing indicia 18 on an outward facing surface of said target 12. This is useful for displaying trademarks, advertisements, instructions, point systems, warnings, and the like. One of the advantages of the target 12 is that the large surface area allows for display of the indicia 18 directly on the target 12. An upper surface of the target 12 can be flattened, as shown in FIG. 2, to provide a scoring surface upon which a projectile 14 may rest. If the opening 16 does not pass through the target, the opening can be closed off with a membrane 17, as shown in FIG. 2. The membrane 17 can be flexible and rigid The target 12 can be stabilized by adding ballast (not shown) to the opening 16 to act as an anchor so that the target 12 is resistant to movement on overturning. The ballast can be sand, dirt, water or any other suitable material.

As shown in FIG. 3, the target may have a solid cross-section. The target 12 may be made from polystyrene, other foaming plastics or other lightweight materials having sufficient density and strength characteristics. In this case, the target 12 would be both lightweight and inexpensive to fabricate in a variety of shapes and colors as it is composed of a single material.

Figure 4:
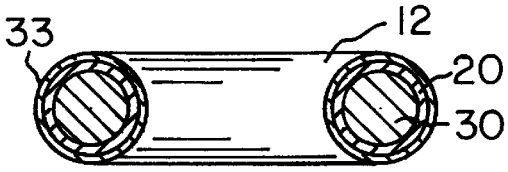
FIG. 4 is a side sectional view of a target having an outer wall and a low-density filler.
Figure 5:
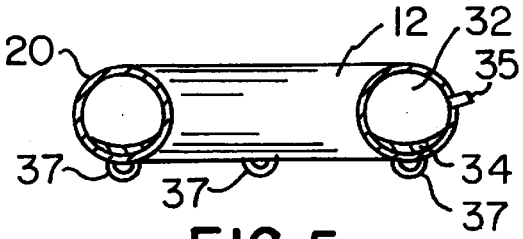
FIG. 5 is a side sectional view of a target showing a pocket of a denser material.

Target 12 may alternatively have a wall 20 filled with a low density filler 30 or a gas 32 as shown in FIGS. 4 and 5, respectively. The wall 20 can be made from a variety of materials. In its simplest form, the wall 20 is a coating that compensates for the well-known drawbacks of polystyrene or other low-density fillers 30, such as crumbling and low strength. The wall 20 may also protect the filler if the filler is other than polystyrene. The wall 20 can be a soft, foaming plastic, such as neoprene, having a fabric outer layer 33, as shown in FIG. 4, adding the benefits of padding combined with the flexibility of coloring and design patterns found in fabrics or other materials useful in preparing such layers. Alternatively, the wall 20 can simply be a fabric or treated fabric, treated, for instance, with a plastic, a protectant or a waterproofing agent.

In another embodiment of the invention, the wall 20 comprises substantially the entire structural component of the target 12. As shown in FIG. 5, the target is a hollow shell filled with a gas 32. The gas 32 may be air or other suitable gases. In one embodiment, the target 12 is manufactured pre-inflated with the gas 32. The wall 20 may be flexible or rigid and have varying thickness. The wall 20 may have a softer coating of one or more of a foaming plastic fabric, a treated fabric or other suitable material. The wall 20 may be made from materials commonly known to those skilled in the art to be suitable to serve as a wall, including, alone or in combination, rigid or flexible plastics such as polyethylene, fabrics, rubber and latex compounds and the like.

In a second embodiment, the wall 20 is inflatable by a user of the target 12. The wall 20 may comprise, alone or in combination, plastics such as polyethylene, treated or untreated fabrics, rubber or latex compounds or other material commonly known to those skilled in the art to be suitable for inflating. The wall 20 has a valve 35, preferably capable of retracting into the wall 20, through which the target 12 is inflated with air. The advantage of inflatable targets is that the target 12 is lightweight and can be stored and transported in a minimal volume prior to or after sale, until reaching a destination, such as a warehouse, store, beach or camp site. Upon reaching the destination, the targets 12 can be inflated to their full volume and, preferably, later deflated after leaving the destination.

As shown in FIG. 5, the target 12 may have an anchor that is an internal pocket 34 of ballast material that is preferably denser than the average density of the target 12, more preferably, denser than water. In one embodiment, the inner pocket 34 is filled with sand. The inner pocket 34 is oriented, generally, on a bottom side of the target 12, but can extend to fill most of the volume of the target. The purpose of filling the inner pocket 34 with the denser material is two-fold. First, because the target 12 is generally very lightweight, it is desirable to make the target 12 more stable in wind gusts, and the like. Second, the inner pocket 34 serves to stabilize the target 12 when the game is played by setting the target 12 afloat in water.

Figure 6:
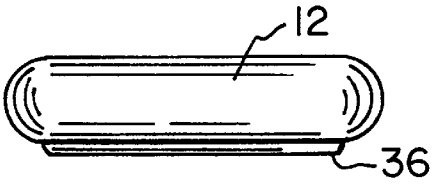
FIG. 6 is an elevation view of a target showing an exterior pocket on the target.
Figure 7:
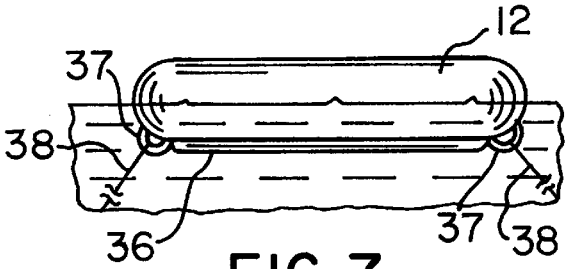
FIG. 7 is an elevation view of a target floating in water.

As shown in FIG. 6, the target 12 can have an anchor that is an external pocket 36, wherein a dense material can be added either during manufacture of the target 12 or at the will of a player of the game. The primary purpose of having an external pocket 36 is to allow the player to add the denser material whenever the game is played. For instance, the external pocket 36 may be filled with water and/or sand when the game is played at the beach; water, rocks or dirt when the game is played at a campground or at home. If more stability is needed, for instance, where there are higher winds, additional dense material may be added. It will be appreciated that the external pocket 36 may be sealable and, further, that it may be integral with the shape of the target 12 such as the inner pocket 34 shown in FIG. 5. The external pocket 36 can be used alone or in combination with the inner pocket 34. Both the inner pocket 34 and the external pocket 36 can extend into the opening 16, integral with or in addition to the membrane 17 as shown in FIG. 2. Hooks 37 can be attached to a side of the target 12 to further stabilize the target and prevent unintended movement. The hooks may be fastened to a surface by spikes, or the like, or by lines 38, for instance, when the target 12 is used in the water, as shown in FIG. 7. The lines 38 can be weighted, attached to anchors or attached to hooks fixed to a surface (not shown).

As shown in FIG. 7, the target 12 may be constructed of a material having a lesser density than water so that the target 12 may float in water and the game may be played in an aquatic setting.

Figure 8:
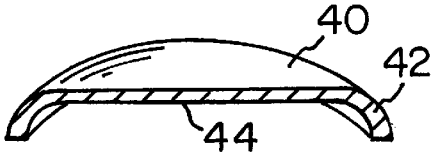
FIG. 8 is a side sectional view of a flying disc projectile.

FIG. 8 shows a cut-away section of a gliding disc 40 which may be used as a projectile 14 when playing the game. Gliding disc 40 preferably has a peripheral wall 42 that is thicker or denser than an interior wall 44 of the gliding disc 40 to allow a person throwing the gliding disc 40 to more accurately throw the gliding disc 40; the thicker or denser peripheral wall adds in-flight stability to the gliding disc 40 when the disc 40 is spun as it is thrown. It will be appreciated that the projectile 14 may be formed or constructed in many different shapes that are more or less aerodynamically stable, such as oblong or spherical balls, i.e., a football or the like.

Figure 9:
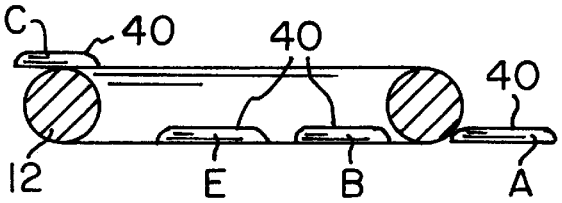
FIG. 9 is a side sectional view of the target showing various scoring positions A–E.

Referring to FIG. 9, the projectile 14 or gliding disc 40 may land in one of four positions, lettered A–C and E in relation to the target 12. In one embodiment, the game may be scored as follows. If tossed gliding disc 40 lands in position A, in contact with an outside surface or outer circumference of target 12, one level of points is scored. If gliding disc 40 lands in position B, in contact with an inner, substantially vertical surface, or inner circumference of target 12, a second level of points is scored. If gliding disc 40 lands in position C, atop the target 12, a third level of points, is scored. If gliding disc 40 lands in position E, within the opening 16, not in contact with the target 12, a fourth level of points is scored. Where opening 16 does not pass completely through target 12, as shown in FIG. 2, if the gliding disc 40 lands on a substantially horizontal portion of target 12, not in contact with a substantially vertical wall, or inner circumference of target 12, the fourth level of points is scored.

In one embodiment, the target 12 and projectile 14 or gliding disc 40 have different characteristics, such as color, indicia, patterns or shapes in order to differentiate between the target 12, projectile 14 and gliding disc 40 of different players.

It will be understood that target 12 may have a shape substantially deviating from a traditional toroidal shape. For instance, the target 12 may be squared, hexagonal or other polygonal shapes. It will also be understood that scoring methods may deviate substantially from the described scoring method, depending upon the number of players, the shape of the target and,whether or not the target is placed in water, on land or above ground.

The above invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A tossing game, comprising:

a. a plurality of gliding discs, at least one of the discs having a different indicator than another of said discs; and b. a plurality of moveable targets having a disc-receiving opening and an indicator, the opening being larger than a major dimension of the discs and the opening is closed off by a water-impermeable membrane extending across the opening, at least one of said targets having a different indicator than another of the targets, the indicators of each of the discs matching the indicators of the targets wherein each target is inflatable and fully collapsible.

2. The tossing game of claim 1, including indicia on an outward facing surface of said targets.

3. A method of playing a tossing game for at least two players, comprising:

a. providing a plurality of gliding discs, at least one of the discs having a different indicator than another of the discs and a plurality of moveable targets having an opening, the opening being larger than a major dimension of the discs and the opening is closed off by a membrane extending across the opening, at least one of the targets has a different indicator than another of the targets, the indicators of each of the discs matching the indicators of the targets, wherein each target is inflatable and fully collapsible;

b. as signing an indicator to at least one player and a different indicator to another player such that each player is assigned a disc and a target having a matching indicator;

c. placing the targets on a surface so that the openings face substantially upward; and d. tossing the discs toward the opening, each player tossing their assigned disc to their assigned target.

4. The method of playing a tossing game as claimed in claim 3, further comprising the step of stabilizing the target by placing a ballast material into the opening and on the membrane, wherein the target has a planar bottom surface and the membrane extends across the bottom surface.

* * * * *